US006038890A

United States Patent [19]

Wang

[11] Patent Number: 6,038,890

[45] Date of Patent: Mar. 21, 2000

[54] CIRCULAR KNITTING MACHINE SHUT-DOWN POSITIONING AND NEEDLE/FEEDER POSITION CONTROL METHOD

[75] Inventor: Ping-Shin Wang, Taipei, Taiwan

[73] Assignee: Pai Lung Machinery Mill Co., Ltd., Taipei, Taiwan

[21] Appl. No.: 09/134,956

[22] Filed: Aug. 17, 1998

[51] Int. Cl.[7] ..... D04B 35/10

[52] U.S. Cl. ..... 66/157; 66/8; 364/470.12

[58] Field of Search ..... 66/157, 158, 160, 66/161–164, 165, 167, 163, 8, 56; 364/470.12, 470.14

[56] References Cited

U.S. PATENT DOCUMENTS 4,455,549 6/1984 Rydborn ..... 66/161
5,353,610 10/1994 Barea ..... 66/161

FOREIGN PATENT DOCUMENTS 004105450 8/1992 Germany ..... 66/161

*Primary Examiner*—Danny Worrell
*Attorney, Agent, or Firm*—Bacon & Thomas

[57] ABSTRACT

In a circular knitting machine shut-down positioning and needle/feeder position control method, two signals of 90° phase difference are obtained from an encoder and then processed through a pulse generator for controlling the positioning of the forward/reverse rotation of the needle signal for controlling the positioning of the forward/reverse rotation of the needle cylinder and the value of the distance between the point of origin of the needle cylinder and the point of origin of the encoder are inputted into a needle position processing circuit for processing into a control signal, permitting the control signal thus obtained to be inputted into a main control circuit of the circular knitting machine for determining the real position of the first needle and the first feeder of the circular knitting machine.

4 Claims, 7 Drawing Sheets

CIRCULAR KNITTING MACHINE SHUT-DOWN POSITIONING AND NEEDLE/FEEDER POSITION CONTROL METHOD

BACKGROUND OF THE INVENTION

The present invention relates to a circular knitting machine shut-down positioning and needle/feeder position control method which accurately controls the positioning of the forward/reverse rotation of the needle cylinder by means of a control signal. The control signal is obtained by processing two signals of 90° phase difference from an encoder through a pulse generator.

According to the electronic control equipment and method of GB1 347 916, two sensing devices 17,19 are induced by a disc 11 to generate two signals (see 23,24 in FIG. 5 of GB1 349 916). The signals are then sent to input logic 47, causing it to produce four signals. The four signals thus obtained are then sent through contact bush 103, crossbar 49, diode plug 105 and AND 97, so as to control magnetic valve means to reciprocate the needles in proper order or synchronously. This structure is complicated and expensive. When the machine is shut down, the needle cylinder is forced by an inertia force to step back, making it impossible to accurately control the position of the first needle. Therefore, for jacquard knitting, the machine must be reset again.

SUMMARY OF THE INVENTION

It is the main object of the present invention to provide a circular knitting machine shut-down positioning and needle/feeder position control method which eliminates the aforesaid problems. It is another object of the present invention to provide a circular knitting machine shut-down positioning and needle, feeder position control method which is easy and inexpensive to achieve. According to one aspect of the present invention, two signals of 90° phase difference are obtained from an encoder and then processed through a pulse generator for controlling the positioning of the forward/reverse rotation of the needle cylinder. According to another aspect of the present invention, the signal for controlling the positioning of the forward/reverse rotation of the needle cylinder and the value of the distance between the point of origin of the needle cylinder and the point of origin of the encoder are inputted into a needle position processing circuit for processing into a control signal, permitting the control signal thus obtained to be inputted a main control circuit of the circular knitting machine for determining the real position of the first needle and the first feeder of the circular knitting machine.

DETAILED DESCRIPTION OF THE PREFERRED EMBODIMENT

Figure 1:
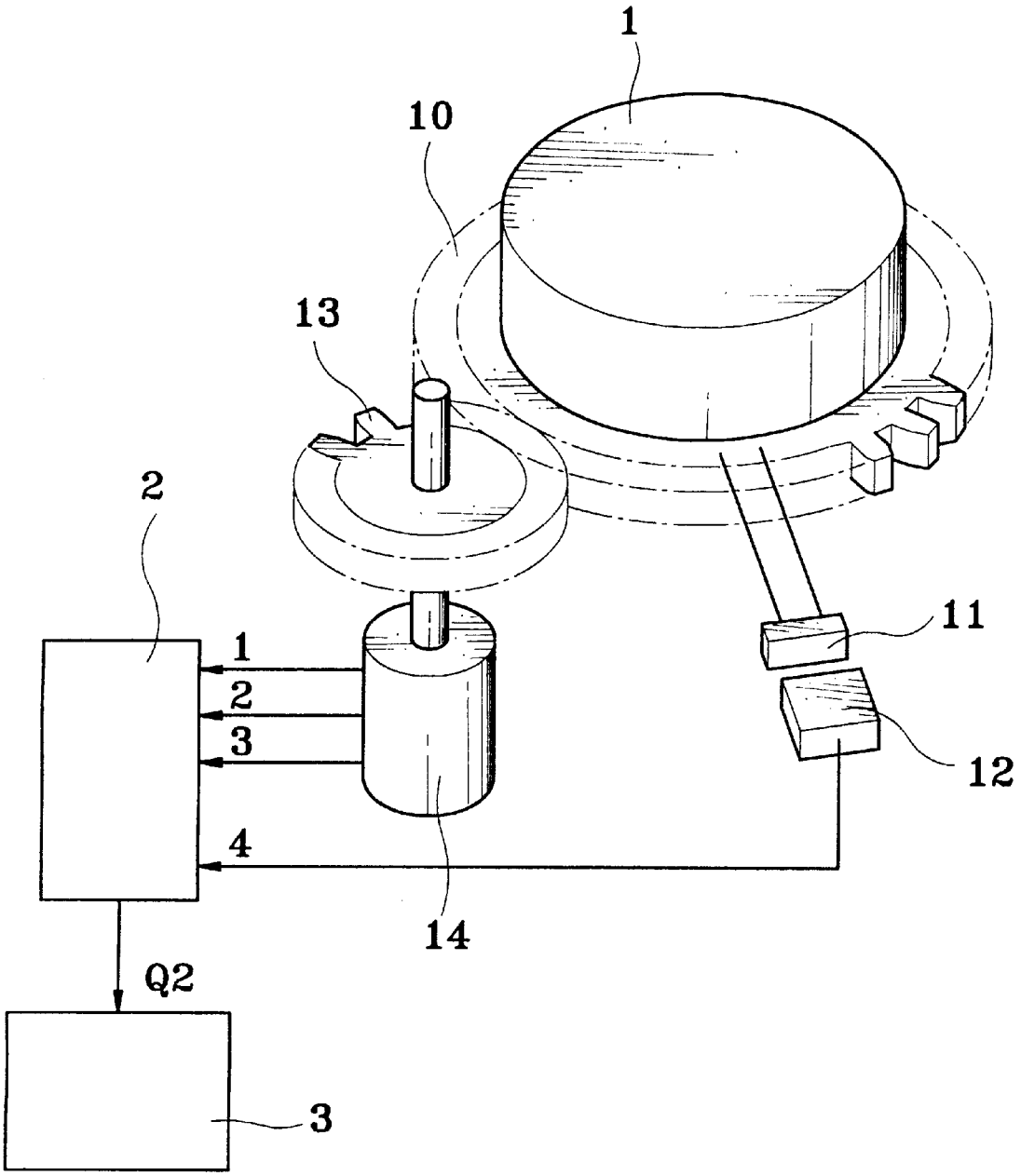
FIG. 1 illustrates the hardware arrangement according to the present invention.

Referring to FIG. 1, a metal plate 11 is mounted on a big gear 10 around the needle cylinder 1. A proximity switch 12 is spaced from the needle cylinder I at a suitable location. The proximity switch 12 is induced to provide an initial signal (point of origin of the needle cylinder). A small gear 13 is fixedly mounted on an encoder 14 and meshed with the big gear 10. Output signals from the proximity switch 12 and the encoder 14 are inputted into a pulse generator 2 for processing into a control signal. The control signal is then sent from the pulse generator 2 to a control circuit 3, controlling it to control the positioning of the circular knitting machine, the position of the first needle and the first feeder.

When reversing a circular knitting machine, the machine is suddenly stopped, and then reversed. When the circular knitting machine is suddenly stopped before reversing, a backward inertia force occurs. In hardware treatment, the backward number of pulse must be retained, and the pulse output must be stopped. The pulse output is started again only when the backward number of pulse is equal to the forward number of pulses.

Figure 2:
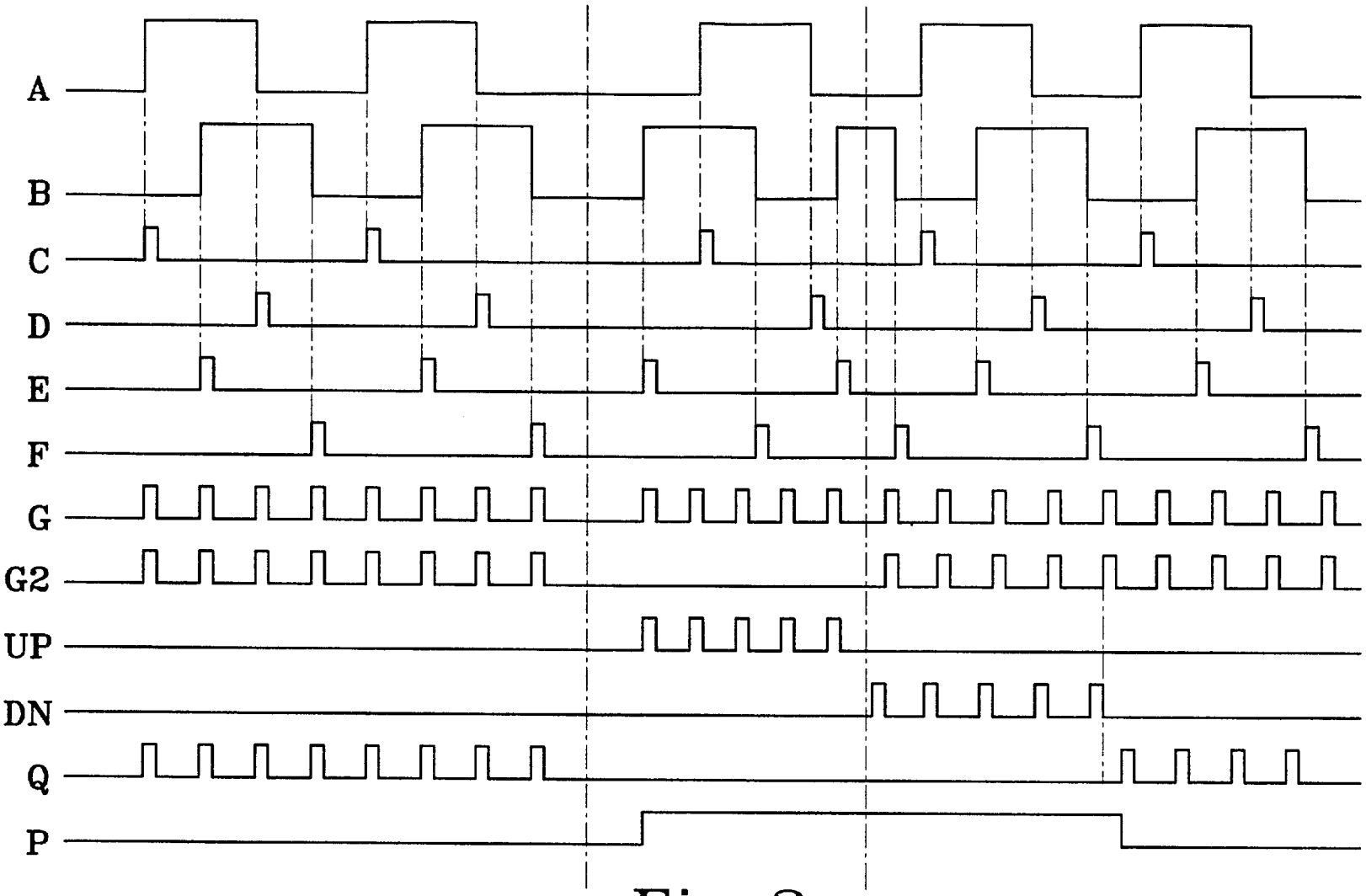
FIG. 2 is a time series chart according to the present invention.
Figure 3:
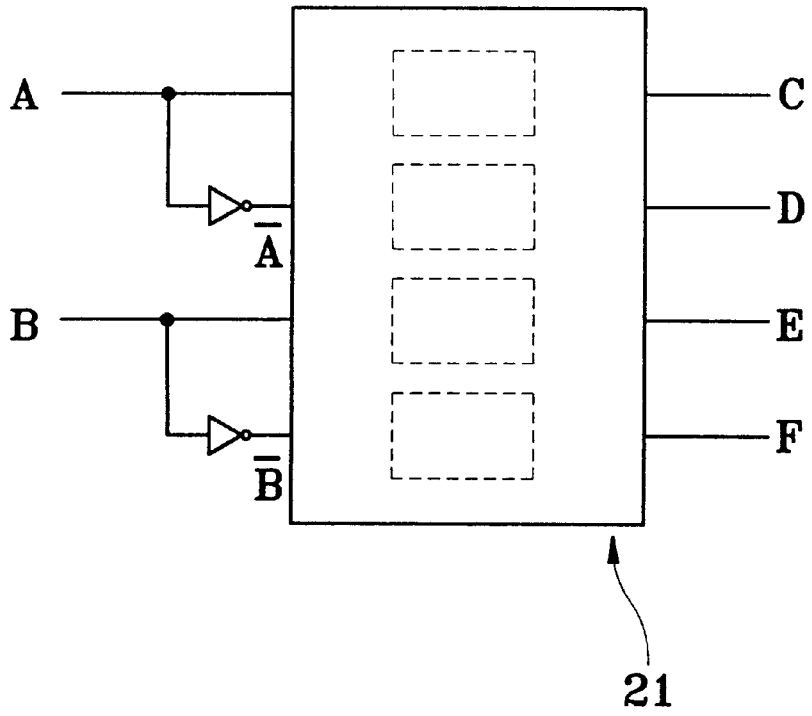
FIG. 3 illustrates the arrangement of the positive/negative triggering circuit according to the present invention.
Figure 4:
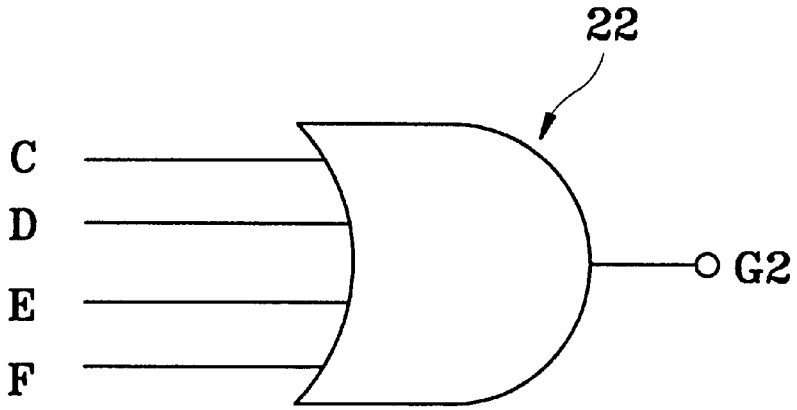
FIG. 4 illustrates the arrangement of the mixer according to the present invention.
Figure 5:
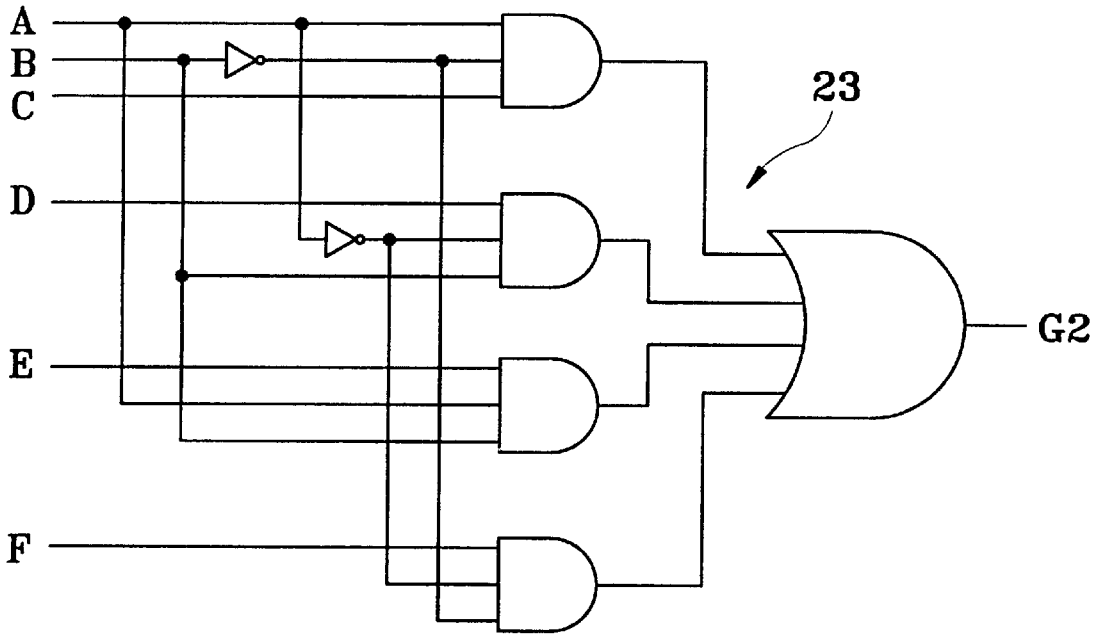
FIG. 5 illustrates the arrangement of the forward pulse processing circuit according to the present invention.
Figure 6:
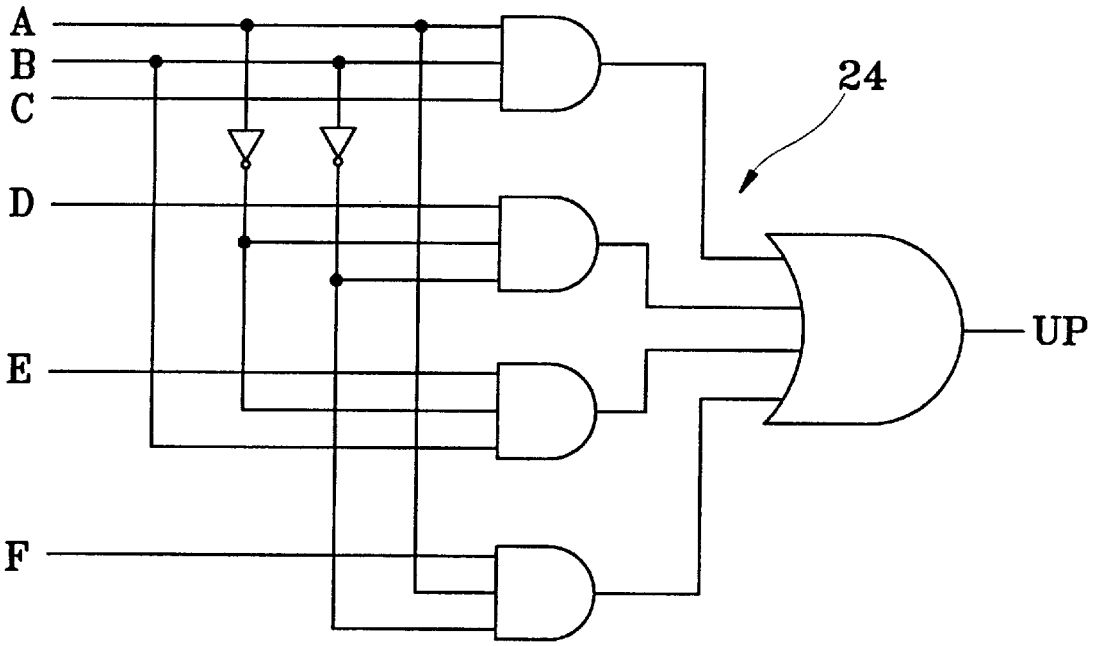
FIG. 6 illustrates the arrangement of the reverse pulse processing circuit according to the present invention.
Figure 7:
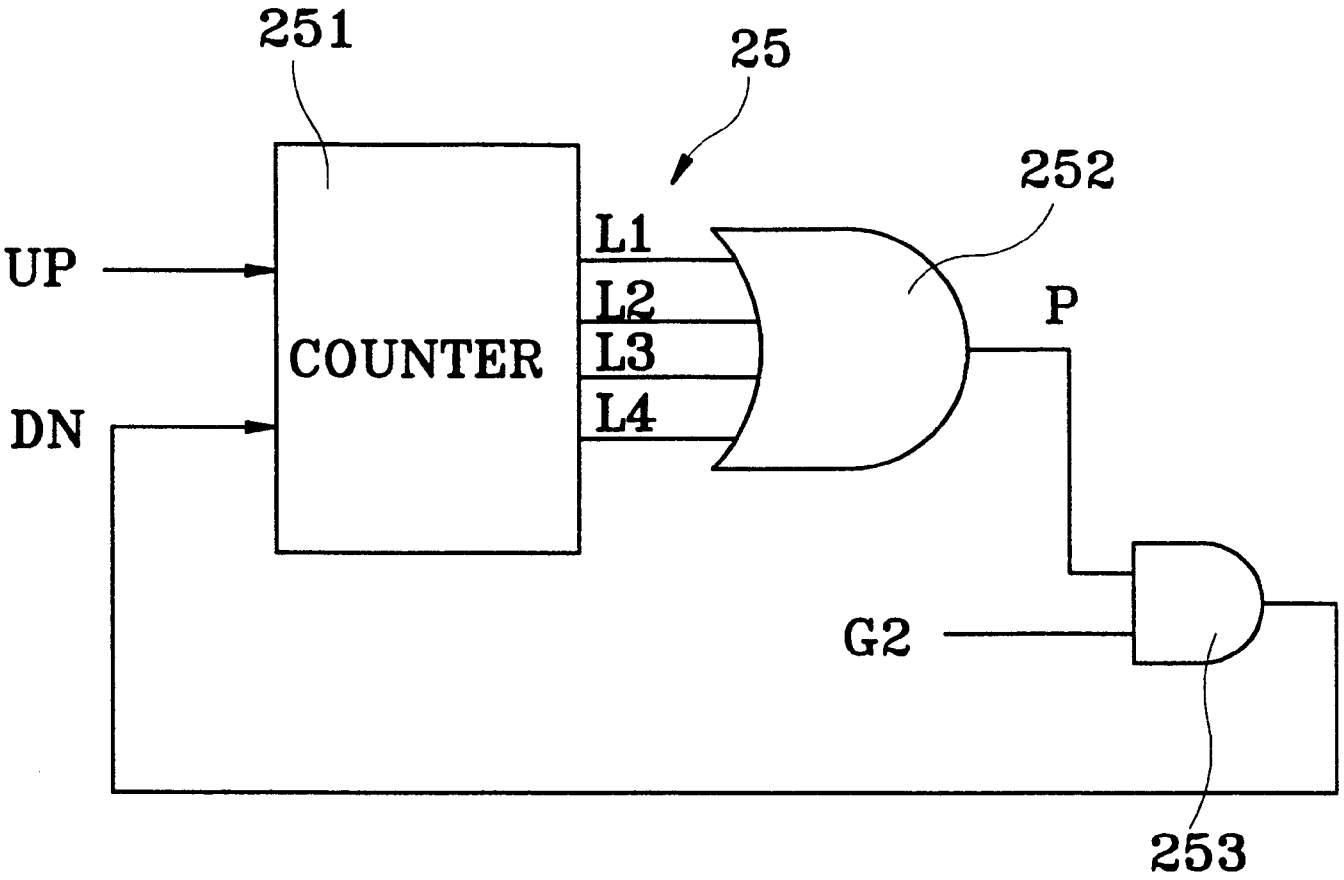
FIG. 7 illustrates the arrangement of the compensation circuit according to the present invention.

Referring to FIGS. from 2 through 7, in order to eliminate the aforesaid reversing problem, signals A,B of 90° phase difference are obtained from the encoder 14, and then respectively inputted into a positive/negative triggering circuit 21 (see FIG. 3), so as to obtain signals C,D,E,F (see FIG. 2). Signals C,D,E,F are then processed through a mixer 22, which is formed of an OR gate, into a pulse signal G (see FIG. 4). The pulse signal G is then processed through a forward pulse processing circuit 23, which is formed of CAB'+DA'B+EAB+FA'B', into a forward pulse signal G2 (see FIG. 5). The forward pulse signal G2 is then processed through a reverse pulse processing circuit 24, which is formed of CAB+DA'B'+EA'B+FAB', into a reversed pulse signal UP (see FIG. 6). The reversed pulse signal UP is then processed by a compensation circuit 25, which is formed of a counter 251, an OR gate 252 and an AND gate 253, into a signal P. The signal P and the signal G2 are then processed through the AND gate 253 of the compensation circuit 25 into a compensation pulse signal DN. The signal DN and the signal UP are then processed through the compensation circuit 25 into a pulse signal Q.

Figure 8:
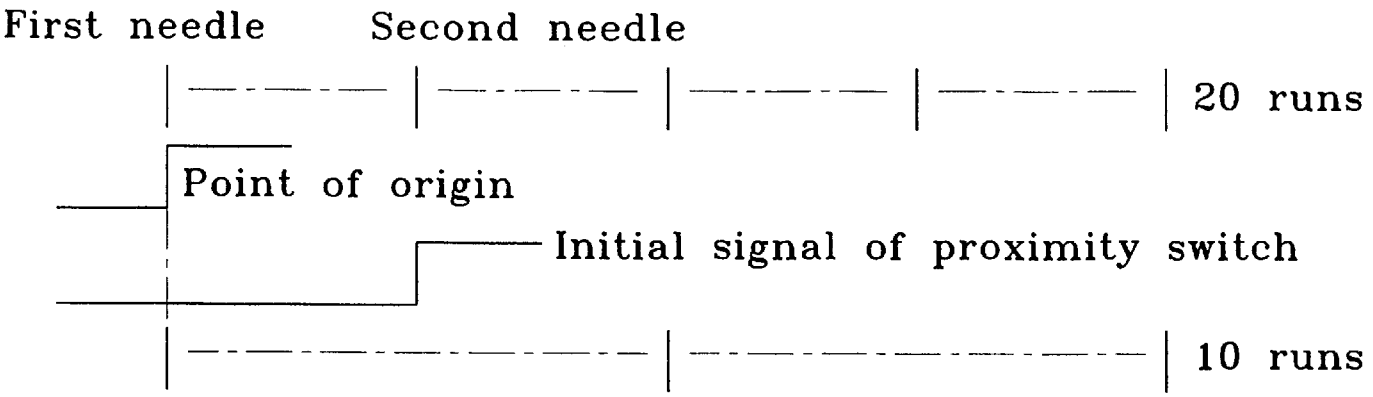
FIG. 8 is a time series chart explaining the determination of the position of the first needle according to the present invention.

Referring to FIG. 8 and FIG. 1 again, when the metal plate 11 of the big gear 10 touches the proximity switch 12, the first needle is started. Because the proximity switch 12 has a signal conversion time delay (magnetic induction converted into potential signal), and the time delay is a little more than 1/10000 second, there is an initiation time difference between a high speed operation and a low speed operation (the difference may be as big as more than one needle). According to the present invention, the mechanical point of origin (the position of the proximity switch 12) is regarded as a reference point, which is compared with the point of origin of the encoder 14, and then a value is obtained from the comparison result and added to the point of origin of the encoder 14, so as to provide a point of initiation.

When deciding the position of every needle and every feeder, assume the gear ratio between the big gear and the small gear is 1:9.6, the circular knitting machine has 48 feeders, and the encoder produces 2000 signal points per one revolution. Thus 9.6×2000=19200 signal points are equally distributed to the machine when the machine is rotated through one run. Therefore, 19200/total number of needles= the relative signal point of each needle, and 19200/total number of feeders=the relative signal point of each feeder. Because there is a mechanical tolerance for the positioning of every feeder, the mechanical tolerance must be compensated. According to the present invention, the signal point of each feeder is corrected, so that the mechanical tolerance is compensated.

Figure 9:
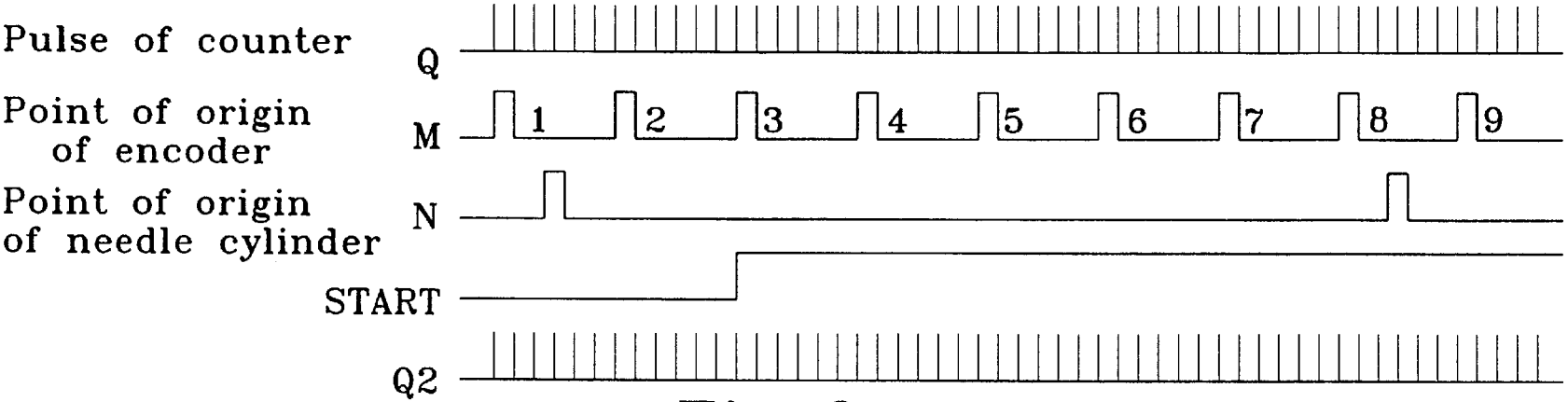
FIG. 9 is a pulse chart explaining the determination of the position of the first needle according to the present invention.
Figure 10:
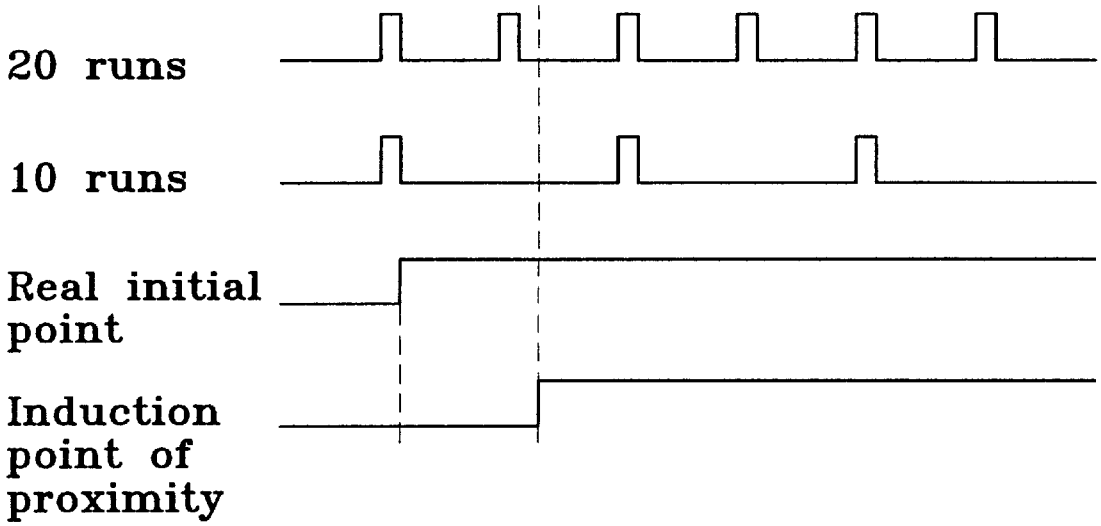
FIG. 10 is a pulse synchronization time series chart according to the present invention.
Figure 11:
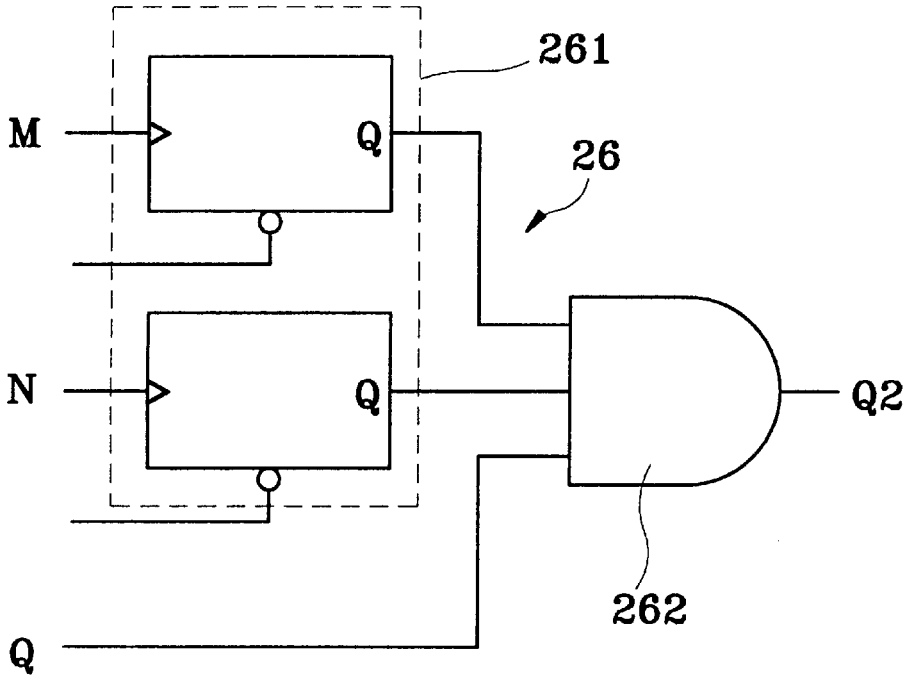
FIG. 11 illustrates the arrangement of the first needle position processing circuit according to the present invention.

Referring to FIGS. 9, 10 and 11, in order to achieve the aforesaid requirements, the initial pulse signal is determined by: mounting a metal plate 11 on the big gear 10 around the needle cylinder 1, and fixing a proximity switch 12 at a fixed point, enabling the proximity switch 12 to be induced by the metal plate 11 to produce a pulse signal (signal N of point of origin of the needle cylinder) when the needle cylinder 1 is rotated through one run. Because the operation of the proximity switch 12 uses magnetic induction which causes a signal conversion time delay, in order to synchronize the initial signal with the pulse signal M of the point of origin of the encoder 14, the signal of point of origin of the needle cylinder (the signal of tangent between the proximity switch 12 and the metal plate 11) and the signal of point for the origin of the encoder 14 are combined together for processing into a signal representative of the point of origin of the needle cylinder, which is synchronized with the signal of point of origin of the encoder.

The so-called synchronization is to prevent an error in the initial pulse due to a different revolving speed of the needle cylinder 1. Because the pulse waveform is relatively denser when the revolving speed of the needle cylinder 1 is increased, or relatively thinner when the revolving speed of the needle cylinder 1 is reduced, and because the reaction time of the proximity switch is fixed, an initial pulse error becomes inevitable if the signal of point of origin of the needle cylinder is not synchronized with the signal of point of origin of the encoder (as shown in FIG. 10, the first pulse is missed due to the reactive time of the proximity switch when at 20 rpm, and no pulse is missed when at 10 rpm).

Signals M,N and signal Q are processed through a processing circuit 26, which is formed of a flip-flop 261 and an AND gate 262, into a first needle position signal Q2. The first needle position signal Q2 is then sent to a main control circuit 3 for processing and for further controlling the positioning of the first needle of the needle cylinder.

What is claimed is:

1. A circular knitting machine position control method in which an output signal of a point of origin of a needle cylinder, and a point of origin of an encoder, are input into a pulse generator and then a signal processed by the pulse generator is input to a main control circuit for controlling positioning of the circular knitting machine and a position of a first needle and a first feeder, comprising the steps of:

obtaining a first signal and a second signal of 90° phase difference from the encoder, and then respectively inputting the first signal and the second signal into a triggering circuit, so as to obtain four signals;

processing the four signals obtained from said triggering circuit through a mixer to obtain a forward pulse signal, processing the forward pulse signal through a reverse pulse processing circuit to obtain a reversed pulse signal, processing the reversed pulse signal obtained from said reverse pulse processing circuit through a compensation circuit to obtain a forwardly reversely processed pulse signal, combining, in a needle position processing circuit, the forwardly reversely processed pulse signal obtained from said compensation circuit with a point of origin signal representative of a point of origin of the needle cylinder to obtain a control signal representative of a distance between the point of origin of the needle cylinder and a point of origin of the encoder, and inputting the control signal into a main control circuit of the circular knitting machine so as to obtain a real position of the first needle of the circular knitting machine.

2. The circular knitting machine position control method of claim 1 wherein the signal representative of the point of origin of the needle cylinder is obtained by:

providing a gear fixed to the needle cylinder, fixedly fastening a metal plate to said gear, enabling said metal plate to be turned with said gear and therefore with the needle cylinder, fixedly mounting a proximity switch in the circular knitting machine, and causing said proximity switch to generate a pulse signal once per each run of the needle cylinder.

3. The circular knitting machine position control method of claim 2 wherein the point of origin of said encoder is obtained by:

fixedly mounting said encoder on an encoder gear meshed with said gear fixed to the needle cylinder.

4. The circular knitting machine position control method of claim 3 wherein positions of every needle and every feeder of the circular knitting machine are determined based on a gear ratio between said gear fixed to the needle cylinder and said encoder gear and on a number of signals to be produced by said encoder per each run of said encoder gear, wherein:

the gear ratio multiplied by a total number of signal points of the encoder equals a total signal points, the total signal points divided by a total number of needles equals a relative of each needle, and the total signal points divided by a total number of feeders equals a relative signal point of each feeder.

* * * * *